US011814782B2

(12) United States Patent
Torigoe

(10) Patent No.: US 11,814,782 B2
(45) Date of Patent: Nov. 14, 2023

(54) SURFACE-PROCESSED FIBER, METHOD FOR MANUFACTURING SAME, THREAD, AND FIBER PRODUCT

(71) Applicant: SHIMA SEIKI MFG., LTD., Wakayama (JP)

(72) Inventor: Shozo Torigoe, Wakayama (JP)

(73) Assignee: SHIMA SEIKI MFG., LTD., Wakayama (JP)

( * ) Notice: Subject to any disclaimer, the term of this patent is extended or adjusted under 35 U.S.C. 154(b) by 653 days.

(21) Appl. No.: 16/613,715

(22) PCT Filed: May 2, 2018

(86) PCT No.: PCT/JP2018/017509
§ 371 (c)(1),
(2) Date: Nov. 14, 2019

(87) PCT Pub. No.: WO2018/211994
PCT Pub. Date: Nov. 22, 2018

(65) Prior Publication Data

US 2020/0071878 A1 Mar. 5, 2020

(30) Foreign Application Priority Data

May 15, 2017 (JP) ..... 2017-096633

(51) Int. Cl.
*D06M 15/15* (2006.01)
*D06M 15/71* (2006.01)

(52) U.S. Cl.
CPC ..... *D06M 15/15* (2013.01); *D06M 15/71* (2013.01)

(58) Field of Classification Search
CPC ..... D06M 16/00; D06M 10/04; D06M 15/15; D06M 14/06; D06M 14/24; D06M 2101/10; D06M 2101/12; Y10T 428/2913–428/2978
USPC ..... 428/346–400
See application file for complete search history.

(56) References Cited

U.S. PATENT DOCUMENTS 2,736,946 A * 3/1956 Stanton ..... D01F 6/38 264/182

FOREIGN PATENT DOCUMENTS

| | | | | |
|---|---|---|---|---|
| AU | 2008202562 A1 * | 7/2008 | ..... | A41G 5/0086 |
| CN | 204918986 U * | 12/2015 | | |
| CN | 105544198 B * | 5/2018 | | |
| EP | 0183222 A2 * | 6/1986 | ..... | D06M 11/54 |
| EP | 3 346 052 A1 | 7/2018 | | |
| JP | S54-30955 A | 3/1979 | | |

(Continued)

OTHER PUBLICATIONS

Hardy, John G, Scheibel, Thomas R.; "Composite materials based on silk proteins"; www.elsevier.com; Progress in Polymer Science 35 (2010) 1093-1115 (Year: 2010).*

(Continued)

*Primary Examiner* — Jennifer A Steele
(74) *Attorney, Agent, or Firm* — Rothwell, Figg, Ernst & Manbeck, P.C.

(57) ABSTRACT

A protein surface layer is formed on a surface of a base fiber comprising a natural protein fiber including silk or a synthetic protein fiber including Chinon. The protein surface layer is divided in a plurality of particles by cracks. The resultant fibers with the protein surface layer divided in particles by cracks affords bulky textile products with an improved texture.

6 Claims, 4 Drawing Sheets

(56) References Cited

FOREIGN PATENT DOCUMENTS

| | | | | | |
|---|---|---|---|---|---|
| JP | S60-224872 | A | | 11/1985 | |
| JP | S61-70075 | A | | 4/1986 | |
| JP | S6170074 | A | * | 4/1986 | ..... D06M 15/15 |
| JP | S61-245375 | A | | 10/1986 | |
| JP | S63-249780 | A | | 10/1988 | |
| JP | H01-246432 | A | | 10/1989 | |
| JP | 2001-031872 | A | | 2/2001 | |
| JP | 2001031872 | A | * | 2/2001 | |
| JP | 2002-348775 | A | | 12/2002 | |
| JP | 2003-287080 | A | | 10/2003 | |
| JP | 2003278080 | A | * | 10/2003 | |
| KR | 810001305 | B1 | | 10/1981 | |
| WO | WO-2016090055 | A1 | * | 6/2016 | ..... A41D 13/0015 |
| WO | 2017038814 | A1 | | 3/2017 | |
| WO | WO-2017038814 | A1 | * | 3/2017 | ..... D06L 4/00 |

OTHER PUBLICATIONS

Morimoto, "Silk-Like Fiber K-6 (Chinon)"; European and Japanese Chemical Industries Symposium; vol. 62, No. 3, Mar. 1970 (Year: 1970).*

Shen, Xinchen; Shi, Haoyuan, "Engineering Natural and Recombinant Silks for Sustainable Biodevices"; Frontiers in Chemistry; May 2022; vol. 10; Article 881028 (Year: 2022).*

International Search Report and Written Opinion dated Jul. 31, 2018 issued in International Application No. PCT/JP2018/017509. (8 pages).

Extended European Search Report dated Feb. 1, 2021 in European Patent Application No. 18802523 (10 pages total).

* cited by examiner

SURFACE-PROCESSED FIBER, METHOD FOR MANUFACTURING SAME, THREAD, AND FIBER PRODUCT

CROSS REFERENCE TO RELATED APPLICATION

This application is a 35 U.S.C. § 371 National Stage of International Patent Application No. PCT/JP2018/017509, filed May 2, 2018, which claims the benefit of Japanese Patent Application No. 2017-096633, filed May 15, 2017, designating the United States. The above identified applications are incorporated by reference.

TECHNICAL FIELD

The present invention relates to fibers with surfaces processed with a protein such as keratin, a method for manufacturing the fibers, and a yarn and textile products using the fibers.

BACKGROUND ART

Producing cashmere-like fibers from silk or other fibers has been desired; however, such techniques seem unknown, as long as the inventor knows.

A technique upon which the present invention is based will be described. The inventor proposed in Patent Document 1 (WO2017/038814A) to immerse cashmere fibers in an aqueous solution of hydrolyzed keratin for, for example, 60 minutes at 40° C. Keratin penetrates into the cashmere fibers and prevents damage of the fibers under bleaching or dyeing. Thus, the fibers can maintain the texture while providing an intended hue. However, keratin is present in a substantially uniform surface layer, without forming a fresh scale-like coating on the surfaces of the cashmere fibers.

PRIOR ART DOCUMENT

Patent Document

Patent Document 1: WO2017/038814A

DISCLOSURE OF THE INVENTION

Problems to be Solved by the Invention

It is an object of the present invention to provide a fiber comprising a base fiber and a protein surface layer that is divided into a plurality of particles by cracks. The fiber is usable to produce bulky textile products with an improved texture.

Means for Solving the Problems

A surface processed fiber according to the present invention comprises a base fiber and a surface layer on the base fiber. The base fiber comprises a natural protein fiber comprising silk or a synthetic protein fiber, such as Chinon. The surface layer comprises a protein distinct from the protein in the base fiber. The surface processed fiber is characterized in that the surface layer is divided into a plurality of particles by cracks.

The surface processed fiber according to the present invention is manufacturable first, for example, by forming, on a surface of a base fiber comprising a natural protein fiber comprising silk or a synthetic protein fiber such as Chinon, a surface layer comprising a protein distinct from the protein in the base fiber.

Then, the surface layer is divided by forming cracks in the surface layer through shrinkage and expansion of the base fiber, by heating the base fiber with the surface layer to shrink the base fiber in a longitudinal direction of the base fiber and to expand the base fiber in a circumferential direction perpendicular to the longitudinal direction at the surface of the base fiber.

When a plurality of the fibers according to the present invention are combined, a yarn is resultant. The yarn preferably comprises the fibers twisted together. More specifically, the yarn is a spun yarn comprising a plurality of short fibers twisted together.

Textile products such as knitted fabrics, woven fabrics, and nonwoven fabrics produced made of the above yarn have the characteristics described below. The fibers with the surface layer divided into a plurality of particles by cracks create open spaces between the fibers due to friction, and thus provide bulky textile products. The fibers hold a large amount of air and have improved heat retention. In addition, the cracks improve the texture of the fibers, such as feel.

The base fiber is a natural protein fiber or a synthetic protein fiber and is, for example, silk which is a natural protein fiber or a synthetic protein fiber. The surface layer is preferably formed from keratin. To achieve cashmere-like texture, the base fiber is preferably silk, and the surface layer is preferably feather-derived keratin.

Natural protein fibers comprising silk and synthetic protein fibers such as Chinon tend to shrink in the longitudinal direction and expand in the direction perpendicular to the longitudinal direction when heated with, for example, hot water. The fibers show such shrinkage and expansion at a temperature of, for example, 60° C. or higher. In contrast, the surface layer is basically isotropic, and thus it shrinks expands in a manner different from the base fiber. As the base fiber shrinks in the longitudinal direction, cracks occur and divide the surface layer into a plurality of particles. With hot water heating, the heating temperature is preferably 40 to 120° C. inclusive, specifically 40 to 85° C. inclusive, or more specifically 40 to 75° C. inclusive. For a relatively longer processing duration, the temperature of hot water is set relatively low within the above range. For a relatively shorter processing duration, the temperature of hot water is set relatively high within the above range.

In the fiber, scale-like particles can be formed by the hot water treatment under selected conditions or through stamping after the surface layer formation and before the hot water treatment. The stamping affords the fiber scale-like particles with intended shapes, and the resultant fiber can have scale-like particles similar to the scales on the surfaces of animal hair fibers.

The surface layer with the cracks may detach the base fiber through, for example, washing. To avoid this, a fixing agent may be added to the fiber to make the particles in the surface layer adhere to the base fiber.

The surface processed fiber according to the present invention is also manufacturable by forming, on a surface of a base fiber comprising a natural protein fiber made of silk or a synthetic protein fiber such as Chinon, a surface layer comprising a protein distinct from the protein in the base fiber.

Then, the base fiber with the surface layer is dried and the base fiber is caused to be drawn under tension. Thereafter, the tension applied to the base fiber is relieved and the base fiber with the surface layer is made to shrink.

By these steps, the surface layer is divided into a plurality of particles by cracks.

The surface layer formed from, for example, keratin becomes easily to crack when the fiber is dried. Preferably, the fiber may be dried to make the surface layer water content not higher than 9% by mass, or specifically not higher than 5% by mass. Then the base fiber with the surface layer is drawn under tension under a dried condition, and then the tension is relieved. If the fiber is drawn during the surface layer formation, when the tension on the fiber is relieved, the surface layer shrinks in the longitudinal direction of the fiber, and is divided into a plurality of particles by cracks. To form cracks more easily, preferably, the fiber is drawn during the surface layer formation and is drawn further immediately before the tension is relieved. Instead of being drawn during the surface layer formation and drying, the surface layer may be drawn immediately before the tension is relieved, and, in this case also, the surface layer is divided into a plurality of particles by cracks. This manufacturing method does not involve shrinkage or expansion in the circumferential direction, and basically creates no gaps in the circumferential direction on the surface layer.

When the cracks develop further, the particles in the surface layer tend to partially peel off the base fiber. In particular, the particles become to peel off at the ends in the longitudinal direction of the base fiber. The particles in the surface layer afford bulkiness and improved heat retention in textile products. The textile products also have a frictional texture with an improved feel, and have an improved texture.

When the particles are peeled off furthermore, the particles overlap at their ends one another in the longitudinal direction of the base fiber and form projections. The projections of the particles in the surface layer can provide bulkier textile products with further improved heat retention. The projections also allow the textile products to be resistant to and recover from bending, thus allowing the textile products to recover easily from bending.

Regarding the manufacture, if the base fiber is made to shrink in the longitudinal direction by heating, cracks are formed in the surface layer, and the particles in the surface layer then overlap one another at the ends in the longitudinal direction of the base fiber. When the base fiber expands in the circumferential direction, cracks and gaps are created between the particles. When the cracks further develop, the particles are made partially peeled off the base fiber at the ends in the longitudinal direction of the base fiber. When the particles peel off more, the ends overlap one another and form projections.

When the base fiber is drawn under tension in the longitudinal direction, the surface layer is cracked and divided into a plurality of particles. When the tension is relieved after that, the fiber shrinks in the longitudinal direction. When the base fiber is drawn further, the particles are made partially peeled off at the ends in the longitudinal direction of the base fiber. Since the base fiber is first drawn and then shrinks, if the particles peel off more, the particles overlap one another at positions where they partially peel off the base fiber to form projections.

BRIEF DESCRIPTION OF THE DRAWINGS

FIG. 9*a*)) shows the fiber with no keratin; and FIG. 9*b*)) shows the fiber with keratin.

MODE FOR CARRYING OUT THE INVENTION

One or more preferred embodiments of the present invention will now be described below.

Embodiments

Figure 1:
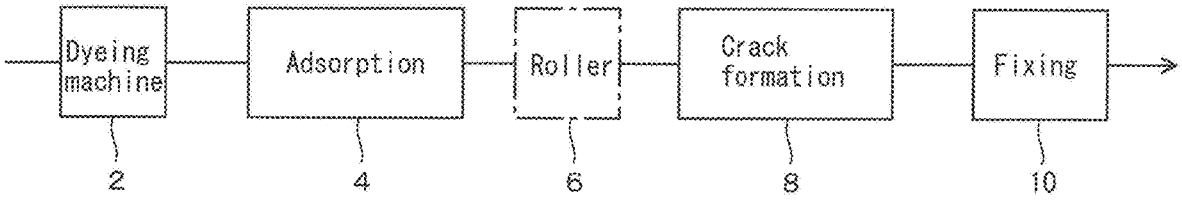
FIG. 1 is a process chart according to an embodiment.

FIGS. 1 to 10 show embodiments. FIG. 1 shows manufacturing processes for a protein-processed fiber. In these processes, for example, a fiber as a base (base fiber) is bleached or dyed by a dyeing machine 2 before a protein surface layer is formed on the base fiber. The base fiber is then immersed in an aqueous solution of a hydrolyzed product of an animal protein such as keratin, fibroin, or sericin, or in an aqueous solution of an artificial or synthetic protein, in an adsorption tank 4. This forms a surface layer of such a protein on the surface of the base fiber. As a remark, base fiber and the protein surface layer have different degrees of shrinkage in hot water.

The fiber with the surface layer is then processed in a crack formation tank 8, and cracks are formed in the protein surface layer. The fiber passes through hot water in the crack formation tank 8, where the base fiber shrinks longitudinally and expands radially. In contrast, the protein surface layer has a smaller degree of shrinkage and expansion. Thus, cracks are formed in the protein surface layer to cause the surface layer to partially peel off the base fiber. In the crack formation tank 8, a monofilament fiber may be processed, or a plurality of fibers may be aligned and processed at a time. The fiber processed in the crack formation tank 8 is subsequently processed in a fixing tank 10. In the fixing tank 10, a fixing agent is added and adhered to the surface layer of the fiber to strengthen adhesion between the protein surface layer and the base fiber.

The fiber with the protein surface layer may be processed, if desired, through a roll machine 6 between the adsorption tank 4 and the crack formation tank 8 to facilitate formation of cracks in the crack formation tank 8. The fiber may be dyed or bleached at any point of time. Before protein adsorption, dyeing or bleaching does not affect the protein surface layer, and also the surface layer can protect the dye to reduce color fading. The processing using a fixing agent can strengthen adhesion between the surface layer and the base fiber. The processing using the fixing agent and the processing using the roll machine 6 may be eliminated.

The base fiber may be, for example, silk, preferably a silk fiber from which its surface sericin is removed and yet to be twisted with other such silk fibers into a yarn. In addition to silk, the base fiber may be a synthetic protein fiber such as Chinon (a synthetic protein fiber formed from casein protein). Animal hairs such as wool have naturally a keratin surface layer, and thus have no need of surface processing with a protein. Plant fibers such as cotton have insufficient amino groups or carboxyl groups bonding with the protein such as keratin, and thus, are not included in the processing target.

The protein usable for surface processing is, for example, keratin, fibroin, or sericin, and may be natural or synthetic. The protein may preferably be keratin. A hydrolyzed protein is obtained by hydrolyzing, for example, feathers or sheep wool by, for example, hydrogen peroxide and ammonia or by sodium hydroxide, adjusting the pH, for example, by hydrochloric acid, and then removing insoluble matter by centrifugation. The average molecular weight can be adjusted by controlling the conditions for hydrolysis. Preferably cations such as hydroxypropyl trimethylammonium ions are attached to the hydrolyzed protein to strengthen the adhesion to the base fiber.

These proteins have preferably an average molecular weight, measured by gel filtration, of 1,000 to 50,000 inclusive, or specifically 3,000 to 50,000 inclusive in order to orient protein particles in the same direction on the surface of the base fiber. The protein in the surface layer may have a dry mass of 1 to 24% inclusive when the dry mass of the base fiber is 100%. The embodiments of the present invention use proteins with larger average molecular weights for surface processing than Patent Document 1. In an experiment conducted by the inventor, no cracks were observed when a protein having an average molecular weight of lower than 1,000 was used. When a protein surface layer has a dry mass of lower than 1% with respect to the base fiber having a dry mass of 100%, no surface layer similar to scales on animal hairs was achieved. The results also reveal that the protein have preferably an average molecular weight of not higher than 50,000 to form a uniform surface layer. The results further reveal that the protein in the surface layer have preferably a dry mass of 1 to 24% inclusive with respect to the base fiber having a dry mass of 100% to form a surface layer having a thickness equivalent to the thickness of animal hair scales. To determine the average molecular weight, the molecular weights including cations, such as hydroxypropyl trimethylammonium ions, are measured. The dry mass of the surface layer was calculated using the difference in dry mass between the base fibers and the processed fibers having the same length.

In the adsorption tank 4, the temperature of the aqueous solution of a hydrolyzed protein is preferably 25 to 40° C. inclusive, and the duration of immersion is preferably 1 second to 10 minutes inclusive. The concentration of the hydrolyzed protein cationized in the aqueous solution is preferably 0.7 to 25% by mass inclusive in terms of the concentration in the aqueous solution including the mass of cations. When the concentration is low, the immersion is made long within the above range. When the concentration is high, the immersion is made short within the above range. The aqueous solution of a hydrolyzed protein may contain a third component such as spinning oil. Since the fixing agent cationizes the protein, an anionic or nonionic fixing agent is preferable. For example, an anionic fixing agent comprising a polyhydric phenol derivative is preferable. FIG. 9*b*) is a fluorescent photograph of a protein fiber processed in the adsorption tank 4. FIG. 9*a*) is a photograph of the fiber before the processing.

The fiber processed with a fixing agent may be, for example, cut into short fibers and processed by carding for use as a spun yarn. However, the long fibers without cutting may be twisted into a yarn.

Figure 2:
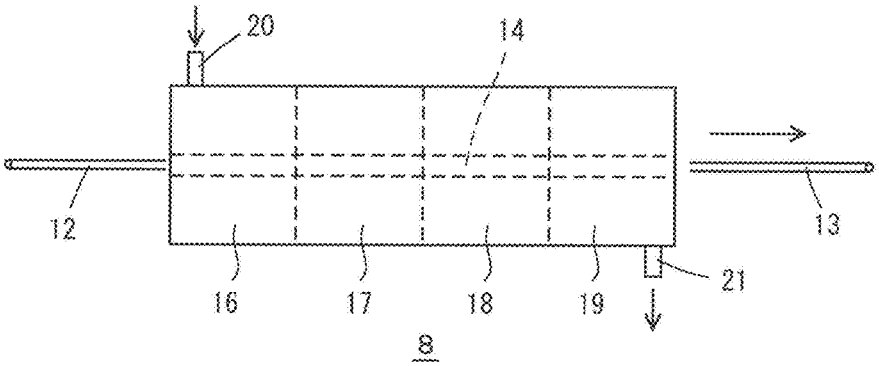
FIG. 2 is a diagram of a crack formation apparatus according to the embodiment.

FIG. 2 shows the structure of the crack formation tank 8. A fiber 12 before forming cracks passes through a path 14 at the center of the tank, where cracks are formed in the protein surface layer, and the fiber then exits as a fiber 13. The crack formation tank 8 includes, for example, a plurality of heat exchangers 16 to 19 arranged in series, supplies water through an inlet 20 into the path 14, and discharges hot water through an outlet 21. The heat exchangers 16 to 19 provide distribution in the water temperature in the path 14. For example, the water temperature is about 40° C. at the heat exchanger 16 near the inlet 20, about 50° C. at the heat exchanger 17, about 60° C. at the heat exchanger 18, and about 75° C. at the heat exchanger 19 with the highest temperature.

When a dry heat system is used, heating by hot air or infrared heating may be used. Silk turns yellow at 190° C. Chinon also deteriorates at 190° C. The processing temperature is thus maintained lower than 190° C.

The highest water temperature in the crack formation tank 8 (the temperature of the heat exchanger 19) is preferably 40 to 120° C. inclusive, or specifically 40 to 85° C. inclusive, or more specifically 40 to 75° C. inclusive. To cause the base fiber, for example, silk to shrink longitudinally and expand radially, the processing temperature is to be at least 40° C. The processing temperature lower than 40° C. causes an insufficient shrinkage and is inappropriate. The duration for which the highest heating temperature is applied in the crack formation tank 8 (the duration taken through the heat exchanger 19) is preferably 1 to 20 seconds. The water flowing through the path 14 in the crack formation tank 8 may contain a third component such as spinning oil.

Figure 3:
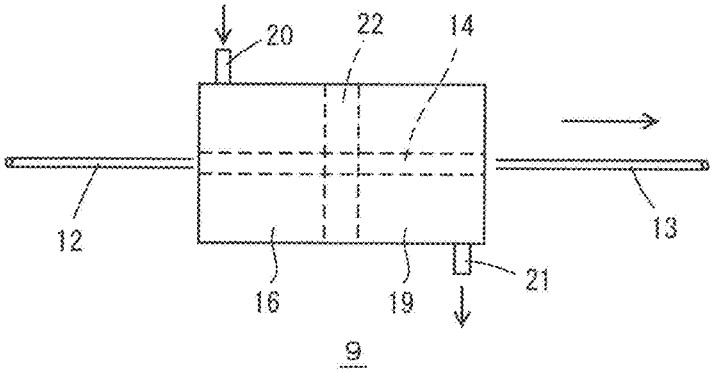
FIG. 3 is a diagram of a crack formation apparatus according to a modification.

FIG. 3 shows a crack formation tank 9 with a steeper distribution of temperatures that includes a thermal insulation layer 22 formed from, for example, silica aerogel and the heat exchanger 16 having the lowest temperature and the heat exchanger 19 having the highest temperature are thermally insulated. When the fiber 12 is fed from the heat exchanger 16 through the heat exchanger 19 in the crack formation tank 9, the fiber 12 is heated rapidly and cracks are easily generated.

Figure 4:
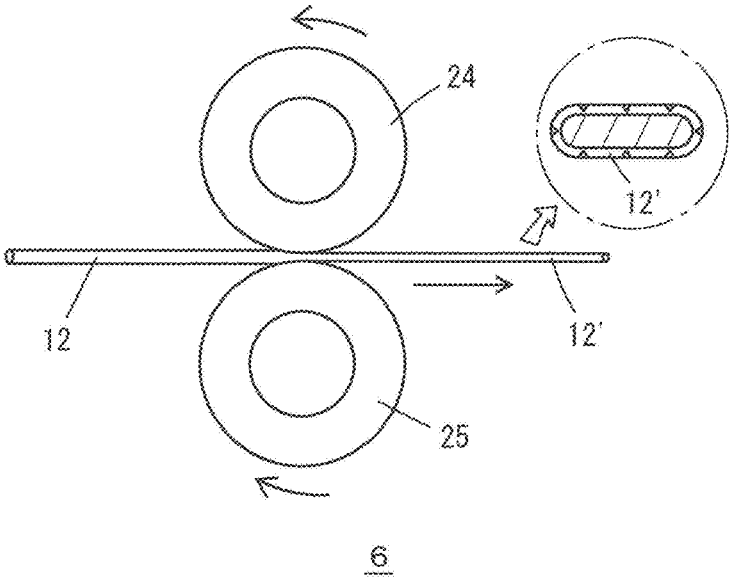
FIG. 4 is a view of rollers used in the modification.
Figure 5:
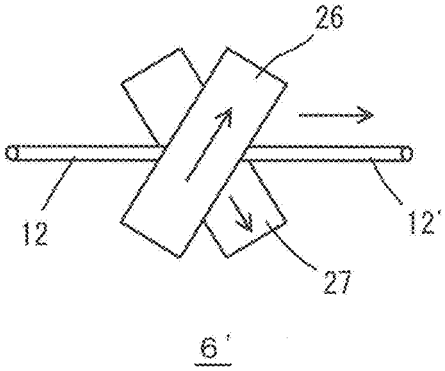
FIG. 5 is a view of texturizing rollers used in another modification.

FIGS. 4 and 5 show examples of the roll machine 6. In FIG. 4, the fiber 12 passes between processing rollers 24 and 25 having fine ridges (not shown) on their surfaces and is converted to a fiber 12'. The fine grooves on the surface layer are stamped through the rollers 24 and 25, and develop into cracks in the crack formation tank 8. The fiber 12 is also compressed through the rollers 24 and 25, and the fiber 12' has a flat cross section as shown in the enlarged view in the upper right of FIG. 4. The surface of the fiber 12 is stamped through the roll machine 6 to have grooves with an intended shape. The particles formed by cracks in the surface layer can thus be controlled into scale-like particles. Further, the scale-like particles can be finely controlled to be, for example, rhombic, triangular, or hexagonal.

In FIG. 4, the upper roller 24 and the lower roller 25 can have different transferring velocities to form cracks on the fiber 12. In this case, the rollers 24 and 25 may have no surface ridges. The cracks develop subsequently in the crack formation tank 8 or 9, and the surface layer can have downstream portions changing into a plurality of particles that partially peel off the base fiber. Although not shown in the figure, a plurality of pairs of upper and lower rollers 24 and 25 in FIG. 4 may be arranged in the transfer direction of the fiber. For example, the transferring velocity of the upstream rollers may be relatively low, whereas the transferring velocity of the downstream rollers may be relatively high to facilitate crack formation. In this case, the upper and lower rollers 24 and 25 may operate at the same velocity or at different velocities.

FIG. 5 shows a roll machine 6' including a pair of texturizing rollers 26 and 27 oriented differently. The fiber 12 passing through the roll machine 6' is twisted to deform the surface layer and facilitate crack formation in the crack formation tank 8. The roll machines 6 and 6' shown in FIGS. 4 and 5 may be eliminated.

Figure 6:
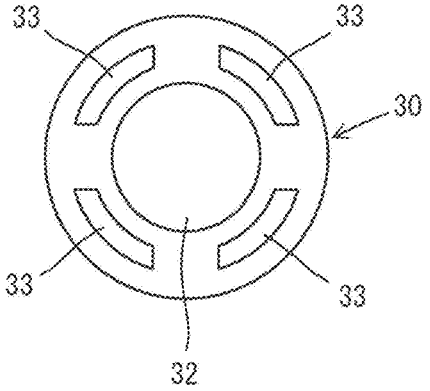
FIG. 6 is a view of a nozzle for spinning a synthetic protein fiber with a keratin coating.

To form a protein surface layer on a synthetic protein fiber, the synthetic protein fiber may be produced and then processed in the same manner as in FIG. 1. However, the protein surface layer may be formed at the same time as fiber producing as shown in FIG. 6. A spinneret 30 ejects a solution to be a synthetic protein fiber from a nozzle 32 at the center, and an aqueous solution of, for example, hydrolyzed keratin from peripheral nozzles 33 surrounding the nozzle 32. Thus, a protein (e.g., keratin) surface layer is formed on the periphery of the synthetic protein fiber.

Figure 7:
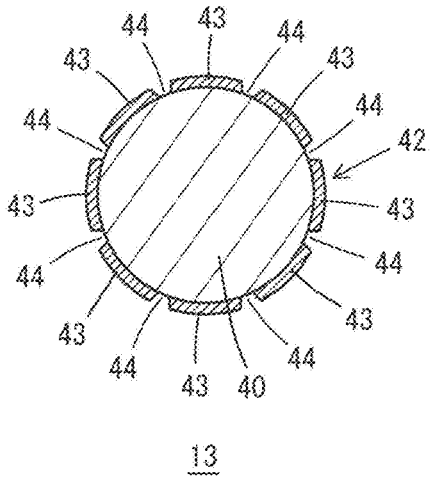
FIG. 7 is a schematic view of a fiber according to the embodiment in its radial cross section.
Figure 8:
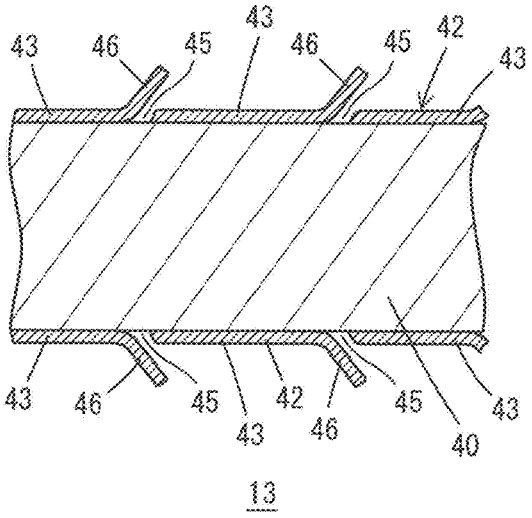
FIG. 8 is a schematic view of the fiber according to the embodiment in its longitudinal cross section.

FIGS. 7 and 8 show schematic cross sections of the resultant fiber 13. When the fiber is heated in the crack formation tank 8 or 9, the base fiber 40 shrinks longitudinally and expands radially. For example, silk undergoes such shrinkage and expansion at 40° C. or higher. In contrast, the surface layer 42 formed from, for example, keratin is basically isotropic, and thus shrinks or expands less than the base fiber 40 in hot water. Further, the surface layer 42 includes protein molecules aligned in the same direction. The surface layer 42 thus cannot conform to the radially expanded base fiber 40, forming cracks 44 mainly in the longitudinal direction of the fiber 13.

Since the surface layer 42 does not conform also to the longitudinally shrank base fiber 40, cracks 45 are formed mainly in the circumferential direction of the fiber 13 (perpendicular to the longitudinal direction on the surface of the fiber 13). The downstream portions of the surface layer 42 are likely to peel off the base fiber in the transfer direction of the fiber 13 in the crack formation tank 8 or 9, thus forming projections. When the cracks 44 connect to the cracks 45, the surface layer 42 is thus divided into particles 43, creating gaps between the particles 43 in the circumferential direction. The particles 43 partially peel off the base fiber 40 near the cracks 44 and 45. Further, the particles 43 can have downstream portions partially peeling off the base fiber 40 in the fiber transfer direction in the crack formation tank 8 or 9, forming projections 46 projecting from the base fiber 40. The particles 43 can thus be oriented.

The particles 43 partially are peeled off the base fiber 40, forming the projections 46. Thus, the fiber 13 becomes bulky, and improves heat retention. The projections 46 are oriented and thus provide a frictional texture with an improved feel. This structure also allows the fiber 13 to easily recover its original shape when bent. Further, the surface layer 42 divided into the particles 43 has reduced gloss. The fiber 13 can be used to provide a bulky textile product with an improved texture and improved recovery from bending. For example, the textile product has cashmere-like texture when silk is used as the base fiber 40 and feather-derived keratin is used as a protein forming the surface layer.

Example Manufacturing Method

Production Examples

A feather-derived raw material was processed in a bath containing alkali at a concentration of 0.2 to 0.8 mol/L at a temperature of 20 to 120° C. for 0.1 to 16 hours. After hydrolysis, acid was added to the bath for neutralization, and insoluble matter was removed by centrifugation. Subsequently, an aqueous solution of hydroxypropyl trimethylammonium chloride was added to the aqueous solution of hydrolyzed protein to make the compound adhere to keratin. For a keratin content of 100% by mass, 0.001 to 20% by mass of hydroxypropyl trimethylammonium ions were added. The average molecular weight of keratin measured by gel filtration ranged from 10,000 to 11,000.

The aqueous solution was adjusted in concentration to 20% by mass of feather-derived keratin, was placed in the adsorption tank 4 and was maintained at 37° C. A monofilament silk fiber after removal of sericin was immersed in the solution for five minutes to form a keratin surface layer. A preliminary experiment had revealed that this silk fiber shrinks longitudinally and expands radially in hot water at 55° C. or higher.

Instead of passing through the roll machine 6, the monofilament fiber is made to pass through the crack formation tank 8 for 10 seconds, and cracks are formed in the surface layer. The temperature in the crack formation tank 8 was 40° C. at the heat exchanger 16 near the inlet, and increased to the highest temperature of 75° C. in increments of about 10° C. per heat exchanger. Subsequently, the surface processed silk fiber having cracks in the surface layer was immersed in an aqueous solution (at 60° C.) containing one gram of an anionic fixing agent per 100 grams of the silk fiber for 20 minutes. Thus, the fixing agent was added to the silk fiber. The surface of the fiber was covered by scale-like particles, or particles defined by longitudinal and circumferential cracks when observed with an electron microscope. These particles partially peeled off the base fiber at the cracks. Specifically, downstream portions of the particles in the transfer direction of the crack formation tank 8 peeled off, thus forming projections. The inventor observed, in manufacturing the fiber according to Patent Document 1, no cracks in the surface of a cashmere fiber immersed in a solution of hydrolyzed keratin with an average molecular weight of about 1,000 and dyed or bleached at 60° C. The low molecular weight allowed keratin to penetrate into the fiber. This seems to be associated with no cracks being formed.

The resultant silk fibers were cut and rubbed, and then carded, aligned, and twisted into a yarn. This yarn provided a bulky textile product with improved heat retention, and also provided a frictional texture with reduced gloss and improved recovery from bending.

Figure 9:
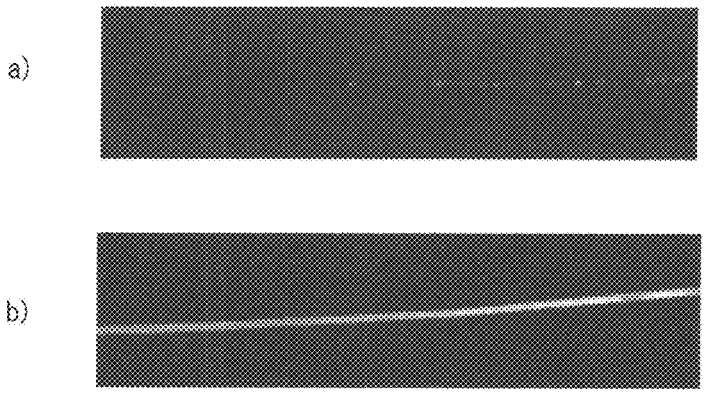
FIG. 9 shows photographs revealing keratin adhering on the fiber.

FIG. 9 shows fluorescent photographs each showing a protein fiber dyed with a fluorescence dye, or specifically rhodamine B after processed with a fixing agent. FIG. 9*a*) shows the image of the fiber without being processed with an aqueous solution of hydrolyzed keratin protein. FIG. 9*b*) shows the image of the fiber processed with the aqueous solution of hydrolyzed keratin protein to form cracks. In comparison with FIG. 9*a*), FIG. 9*b*) shows the fiber surface covered by keratin protein.

Figure 10:
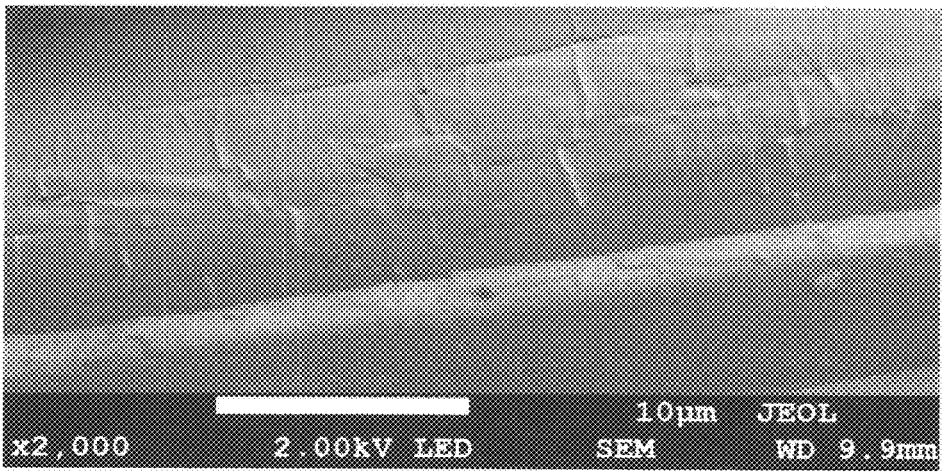
FIG. 10 is an electron micrograph of the fiber according to the embodiment.

FIG. 10 is an electron micrograph of a fiber manufactured according to the production and example shows the fiber has been processed through the crack formation tank and has yet to be processed with a fixing agent. The keratin surface layer is divided into a plurality of rectangular particles by cracks in the longitudinal and circumferential directions of the fiber. The particles overlap one another at cracks in the circumferential direction of the fiber, thus forming projections.

Embodiment 2

Figure 11:
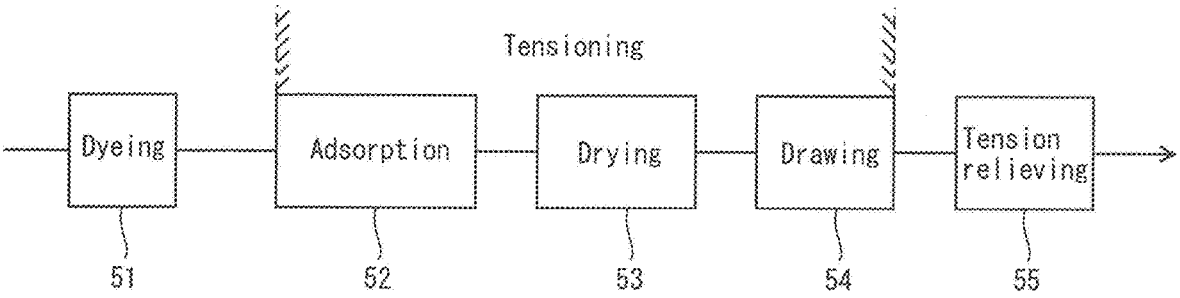
FIG. 11 is a process chart according to a second embodiment.

FIG. 11 shows a method for manufacturing a surface processed fiber according to a second embodiment. This method is the same as in the embodiment described with reference to FIG. 1 unless otherwise specified below. A refined silk fiber is dyed in a dyeing step 51, if desired. Subsequently, the silk fiber is immersed in a hot aqueous solution of feather-derived keratin to form a surface layer in an adsorption step 52. Then, the silk fiber is dried by, for example, heated air to have a water content of not more than 9% by mass, or specifically not more than 5% by mass in a drying step 53. Under the same drying conditions as the drying step, the fiber is drawn in a drawing step 54, and the tension applied to the fiber is relieved in a tension relieving step 55.

For example, in the adsorption step 52, the silk fiber preliminarily drawn by 6% in the longitudinal direction was immersed in an aqueous solution, containing 10% by mass of feather-derived keratin with an average molecular weight of 1,500, for five minutes, at a liquid temperature of 60° C. The degree by which the fiber is drawn is expressed as the percentage of the increased length of the silk fiber before processed. Although not limited to specific values, the manufacturing conditions described below may be used.

Average molecular weight of feather-derived keratin: 1,000 to 3,000 inclusive;

Liquid temperature: 40 to 70° C. inclusive;

Keratin concentration: 2 to 15% by mass inclusive;

Immersion duration: 1 second to 15 minutes inclusive;

Drawing ratio: 3 to 10% inclusive.

In the drying step 53, the fiber was dried with air heated to 80° C. for three minutes and 40 seconds. A silk fiber with no surface layer was dried under the same drying conditions, and its change in weight was measured. The results revealed that the water content of the silk fiber with no surface layer was reduced to 3 to 4% by mass. The drawing ratio for silk was, for example, maintained the same as in the adsorption step 52. In the drawing step 54, the fiber was further drawn by up to 12% under heated air flow with a temperature of 80° C. by increasing the circumferential velocity of the downstream rollers in comparison with the upstream rollers. Subsequently, in the tension relieving step 55, the tension applied to the fiber was relieved, and the ambient atmosphere was returned to room temperature and room humidity. Thus, the drawing ratio of the fiber was reduced to about 3%. The manufacturing conditions described below may be used. The drying temperature in the drying step 53 may differ from the drying temperature in the drawing step 54. In the tension relieving step, the ambient temperature may be rapidly lowered to room temperature or lower to easily allow the particles to partially peel off the surface layer and to form projections. However, the tension may be relieved during heating, and the relative humidity in the tension relieving step may be determined appropriately.

Drying temperature: 70 to 120° C. inclusive;

Drying duration: 15 seconds to 5 minutes inclusive;

Drawing ratio in drying step: 3 to 10% inclusive;

Drawing ratio in drawing step: 10 to 24% inclusive.

The surface layer undergoes the drying step 53 to facilitate crack formation when the fiber is drawn in the drawing step 54. The drawing ratio is then lowered in the tension relieving step to less than the drawing ratio in the adsorption step 52. Thus, the surface layer shrinks and is divided into a plurality of particles by forming cracks. The particles are partially peeled off, for example, in the longitudinal direction of the silk fiber, and the projections are formed, thus providing a cashmere-like feel. The surface layer formed in the manner described above firmly adheres to the silk fiber, thus eliminating the processing using a fixing agent. Both mono-fibers and spun yarns may be processed.

The silk base fiber may be drawn in the drawing step 54 alone, without being drawn in the adsorption step 52 and the drying step 53. In this case, the same conditions as described above may be used except the drawing ratio. With the fiber not drawn in the adsorption step, the drawing ratio in the drawing step 54 is preferably 3 to 24% inclusive, or may, for example, be 12% as described above. Under these conditions, the surface layer undergoes the drying step 53 to facilitate crack formation in the drawing step 54. In the tension relieving step 55, the surface layer is divided into a plurality of particles by forming cracks. The particles then partially peel off in, for example, the longitudinal direction of the silk fiber to form projections.

When cracks are small, particles in the surface layer may peel off slightly with no projections being observed. However, the fibers with the surface layer divided into a plurality of particles by cracks can have more friction between them to provide bulky textile products with improved heat retention. Such cracks also change the texture of the product including feel. When the cracks develop, and the particles in the surface layer are partially peeled off the base fiber, the textile products can provide a frictional texture with an improved feel. When the particles are peeled off still more to form projections, the textile products can be resistant to and recover from bending, thus allowing the textile product to recover easily from bending.

DESCRIPTION OF REFERENCE NUMERALS

2 dyeing machine
4 adsorption tank
6 roll machine
8, 9 crack formation tank
10 fixing tank
12, 13 fiber
14 path
16 to 19 heat exchanger
20 inlet
21 outlet
22 thermal insulation layer
24, 25 processing roller
26, 27 texturizing roller
30 spinneret
32, 33 nozzle
40 base fiber
42 surface layer
43 particle
44, 45 crack
46 projection
51 dyeing step
52 adsorption step
53 drying step
54 drawing step
55 tension relieving step

The invention claimed is:

1. A surface processed fiber comprising:

a base fiber comprising silk; and a surface layer on the base fiber, wherein the surface layer comprises feather-derived keratin, wherein the surface layer is divided into a plurality of particles by cracks formed in longitudinal and circumferential directions with respect to a longitudinal direction of the base fiber, and wherein the particles are partially peeled off at ends thereof in the longitudinal direction of the base fiber.

2. The surface processed fiber according to claim 1, wherein ends of the particles overlap one another in a longitudinal direction of the base fiber so as to form projections.

3. The surface processed fiber according to claim 2, wherein the particles are scale-like.

4. The surface processed fiber according to claim 1, further comprising an anionic or nonionic fixing agent.

5. A yarn comprising a plurality of the surface processed fibers according to claim 1.

6. A textile product comprising the yarn according to claim 5.

* * * * *